US011648455B2

(12) United States Patent
Valencia

(10) Patent No.: US 11,648,455 B2
(45) Date of Patent: May 16, 2023

(54) WEARABLE PROTECTIVE EQUIPMENT WITH SELECTIVE PADDING PLACEMENT AND ORIENTATION

(71) Applicant: Lisa Ivette Valencia, Redondo Beach, CA (US)

(72) Inventor: Lisa Ivette Valencia, Redondo Beach, CA (US)

(73) Assignee: Lisa I Valencia, Crestline, CA (US)

( * ) Notice: Subject to any disclaimer, the term of this patent is extended or adjusted under 35 U.S.C. 154(b) by 233 days.

(21) Appl. No.: 17/113,489

(22) Filed: Dec. 7, 2020

(65) Prior Publication Data

US 2021/0129009 A1 May 6, 2021

Related U.S. Application Data

(63) Continuation-in-part of application No. 16/394,742, filed on Apr. 25, 2019, now abandoned.

(51) Int. Cl.

| | |
|---|---|
| ***A63B 71/14*** | (2006.01) |
| ***A41D 13/08*** | (2006.01) |
| ***A41D 13/05*** | (2006.01) |

(52) U.S. Cl.

CPC ..... *A63B 71/14* (2013.01); *A41D 13/0575* (2013.01); *A41D 13/081* (2013.01); *A41D 2300/20* (2013.01); *A41D 2600/10* (2013.01); *A63B 2209/10* (2013.01); *A63B 2244/102* (2013.01)

(58) Field of Classification Search

CPC ... A63B 71/14; A63B 2009/10; A63B 71/146; A63B 2209/10; A41D 13/081; A41D 2300/20; A41D 2600/10; A41D 20/00; A41D 13/088; A41D 20/005; A41D 19/01582; A41D 19/01588; A41D 13/087

See application file for complete search history.

(56) References Cited

U.S. PATENT DOCUMENTS

| | | | | |
|---|---|---|---|---|
| 3,049,717 | A * | 8/1962 | Meyer | A41D 13/088 D29/113 |
| 5,592,694 | A * | 1/1997 | Yewer, Jr. | A41D 13/081 2/161.1 |
| 5,713,837 | A * | 2/1998 | Grim | A61F 5/0111 602/5 |
| 2017/0143530 | A1* | 5/2017 | Gaylord | A61F 5/0118 |
| 2019/0380402 | A1* | 12/2019 | Lombard | A41D 13/087 |

* cited by examiner

*Primary Examiner* — Daniel J Colilla

(74) *Attorney, Agent, or Firm* — John Kaiser

(57) ABSTRACT

A material worn for protection of the hand against injury and provide physical support and protection to the musculoskeletal systems of the hand and wrists. The material is designed wrap around the hands and wrists in a customizable manner that allows placement of various protection and support elements within the garment. The material is also designed in various manners such as thickness and physical composition depending on the portion of the material and where it will be placed during use.

14 Claims, 9 Drawing Sheets

WEARABLE PROTECTIVE EQUIPMENT WITH SELECTIVE PADDING PLACEMENT AND ORIENTATION

CROSS-REFERENCE

This application is a continuation in part of U.S. patent application Ser. No. 16/394,742, entitled, "Primero Boxing Handwraps" filed Apr. 25, 2019, which is incorporated herein by reference in its entirety.

TECHNICAL FIELD

The present disclosure relates to athletic protective equipment and athletic protective garments. More particularly, the disclosure relates to an improved athletic protective garment providing hand and wrist protection and support to an athlete.

BACKGROUND

Athletes are generally challenged to push their bodies beyond their physical limits. Achieving such performance can be facilitated with innovative equipment that assists the athlete. Such athletic equipment may also, or separately, assist with preventing an injury or reducing the probability of the injury occurring.

In the industry of boxing, injury is a very important factor. An injury can prevent training or even performance of a match. In boxing, injuries can occur several ways, such as typical sports training injuries or injuries resulting from the effective performance of an opponent. An effective boxer is always seeking to improve endurance, speed, power, agility without generating injuries related to overuse or over training. This invention allows boxers to push their training longer by providing better protection with more support in an ergonomically friendly and physically symmetrical manner.

SUMMARY

Aspects and advantages of the invention will be set forth in part in the following description, or may be obvious from the description, or may be learned through practice of the invention.

In general, one innovative aspect of the subject matter described in this specification can be embodied in a hand wrap that includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the thickness of the second region is about twice the thickness of the first region.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the second region is configured to be positioned at the palmar sides of a wrist of the user when the hand wrap is worn by the user.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein all of the regions of the wrap material are made of the same material.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the second region is made of two different materials.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the hand wrap further comprises of an insert, wherein the insert is positioned within the pocket.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the hand wrap further comprises of an insert, wherein the insert is positioned within the pocket, wherein the insert is padding.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the hand wrap further comprises of an insert, wherein the insert is positioned within the pocket, wherein the insert is padding, further wherein the padding is neoprene padding.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the hand wrap further comprises of an insert, wherein the insert is positioned within the pocket, wherein the hand wrap comprises of multiple inserts, wherein the multiple inserts are positioned into the pocket.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the hand wrap further comprises of an insert, wherein the insert is positioned within the pocket, wherein the hand wrap comprises of multiple inserts, wherein the multiple inserts are positioned into the pocket, wherein the multiple inserts have substantial differing physical characteristics from each other.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the loop of the hand wrap is configured to be attached to the first region.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the loop of the hand wrap is configured to receive a user's index finger when worn.

In some embodiments, the hand wrap includes at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region, wherein the hand wrap is designed to be specifically compatible with either a right hand or a left hand of a user.

In some other embodiments of this invention corresponding methods for making a hand wrap are included. Methods can include the actions of forming a wrap material with at least one pocket and two regions wherein the pocket is located at the first region and the thickness of the wrap material at a second region is thicker than the thickness of wrap material at the first region; forming at least one loop; and, forming at least one fastening attachments.

In some embodiments of corresponding methods for making the invention, the method includes forming a wrap material with at least one pocket and two regions wherein the pocket is located at the first region and the thickness of the wrap material at a second region is thicker than the thickness of wrap material at the first region; forming at least one loop; and, forming at least one fastening attachments wherein that the pocket is formed with an opening and an insert is placed within the pocket by way of the insert.

In some embodiments of corresponding methods for making the invention, the method includes forming a wrap material with at least one pocket and two regions wherein the pocket is located at the first region and the thickness of the wrap material at a second region is thicker than the thickness of wrap material at the first region; forming at least one loop; and, forming at least one fastening attachments wherein the pocket is formed with an opening and an insert is placed within the pocket by way of the insert, and wherein the insert is made of ortho-gel.

In some embodiments of corresponding methods for making the invention, the method includes forming a wrap material with at least one pocket and two regions wherein the pocket is located at the first region and the thickness of the wrap material at a second region is thicker than the thickness of wrap material at the first region; forming at least one loop; and, forming at least one fastening attachments wherein the wrap material is formed from continuous flexible material.

In some embodiments of corresponding methods for making a hand wrap, the method includes forming a wrap material with at least one pocket and two regions wherein the pocket is located at the first region and the thickness of the wrap material at a second region is thicker than the thickness of wrap material at the first region; forming at least one loop; and, forming at least one fastening attachments wherein the wrap material has two ends and the fastening attachment and one loop at are opposite ends.

In some embodiments of corresponding methods for making a hand wrap, the method includes forming a wrap material with at least one pocket and two regions wherein the pocket is located at the first region and the thickness of the wrap material at a second region is thicker than the thickness of wrap material at the first region; forming at least one loop; and, forming at least one fastening attachments wherein the wrap material has two ends and the fastening attachment and second region are at one end and the one loop and pocket are at the opposite end.

In some embodiments of corresponding methods for making a hand wrap, the method forming a wrap material with at least one pocket and two regions wherein the pocket is located at the first region and the thickness of the wrap material at a second region is thicker than the thickness of wrap material at the first region; forming at least one loop; and, forming at least one fastening attachments wherein the wrap material has two ends and wherein the second region has an added layer and wherein the added layer of the second region and the pocket are on the same side and opposite ends.

BRIEF DESCRIPTION OF THE FIGURES

A full and enabling disclosure of the present invention, including the best mode thereof, directed to one of ordinary skill in the art, is set forth in the specification, which makes reference to the appended drawings in, which.

Figure 1:
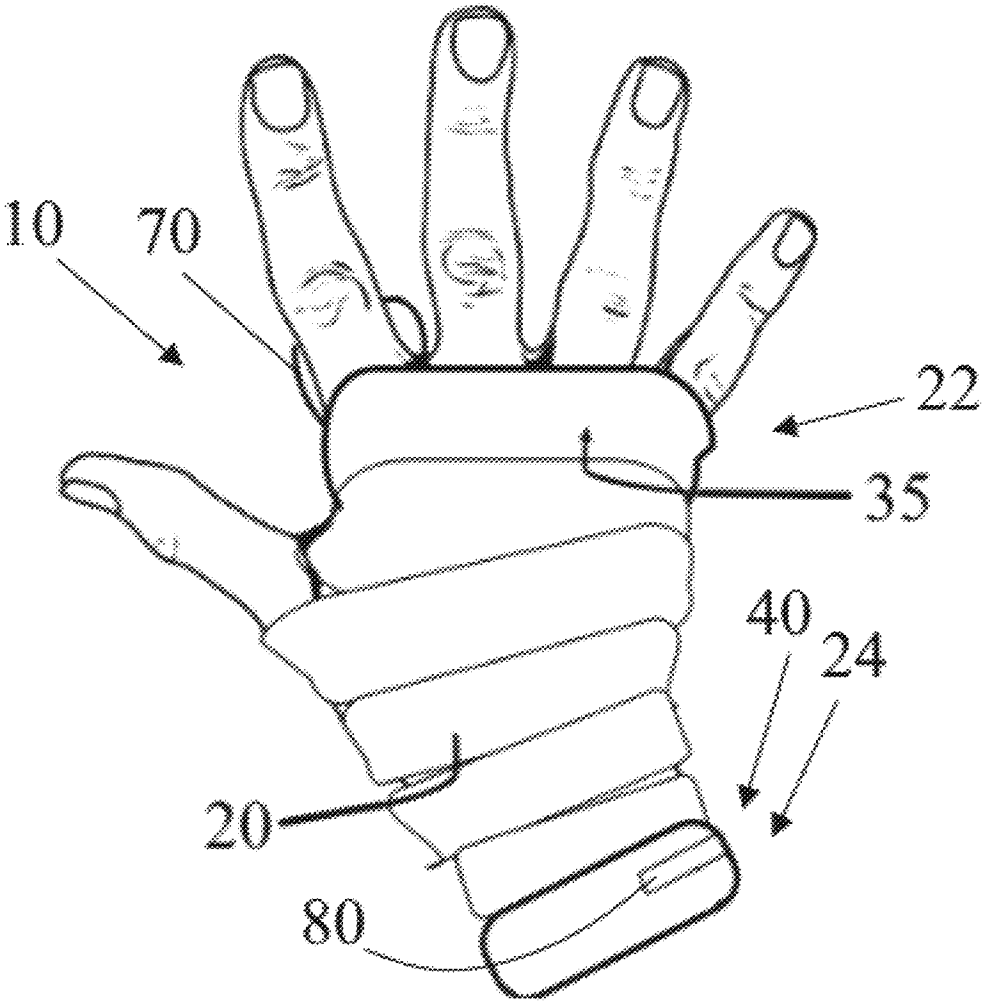
FIG. 1 is a top view of an exemplary embodiment of a hand and the hand wrap 10, wherein it shows the position of the invention when worn by the user and wherein the hand wrap is designed for the right hand of the user.

Repeat use of reference characters in the present specification and drawings is intended to represent the same or analogous features or elements of the present invention.

DETAILED DESCRIPTION

Reference now will be made in detail to the embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

In accordance with the present invention, an athletic accessory to be worn to during sporting activity includes an athletic hand wrap material with improve padding placement, integration and material that allows improve performance, fit and safety.

As shown throughout the figures, the hand wrap 10 includes a wrap material 20. This wrap material 20 can be various types of material such as, but not limited to, gauze, cotton, polyester, cotton batting, leather, synthetic leather, wool, silk, rayon, nylon, taffeta, horse hair, adhesive, felt, othro gel, rubber, vinyl, acrylic and poly vinyl chloride polyurethan, polyethylene, polyborosiloxine, ethylvinylacetate, polyvinylchloride various types of foam including, but not limited to, open-cell foams, closed-cell foams, urethane foam, polyurethane foam, polyvinyl chloride (PVC) foam, memory foam, and other commonly known types of fabric padding, as well as various combinations of these materials. In some embodiments, the wrap material 20 is stretchy. In some embodiments, the wrap material 20 has elastic features.

Figure 2:
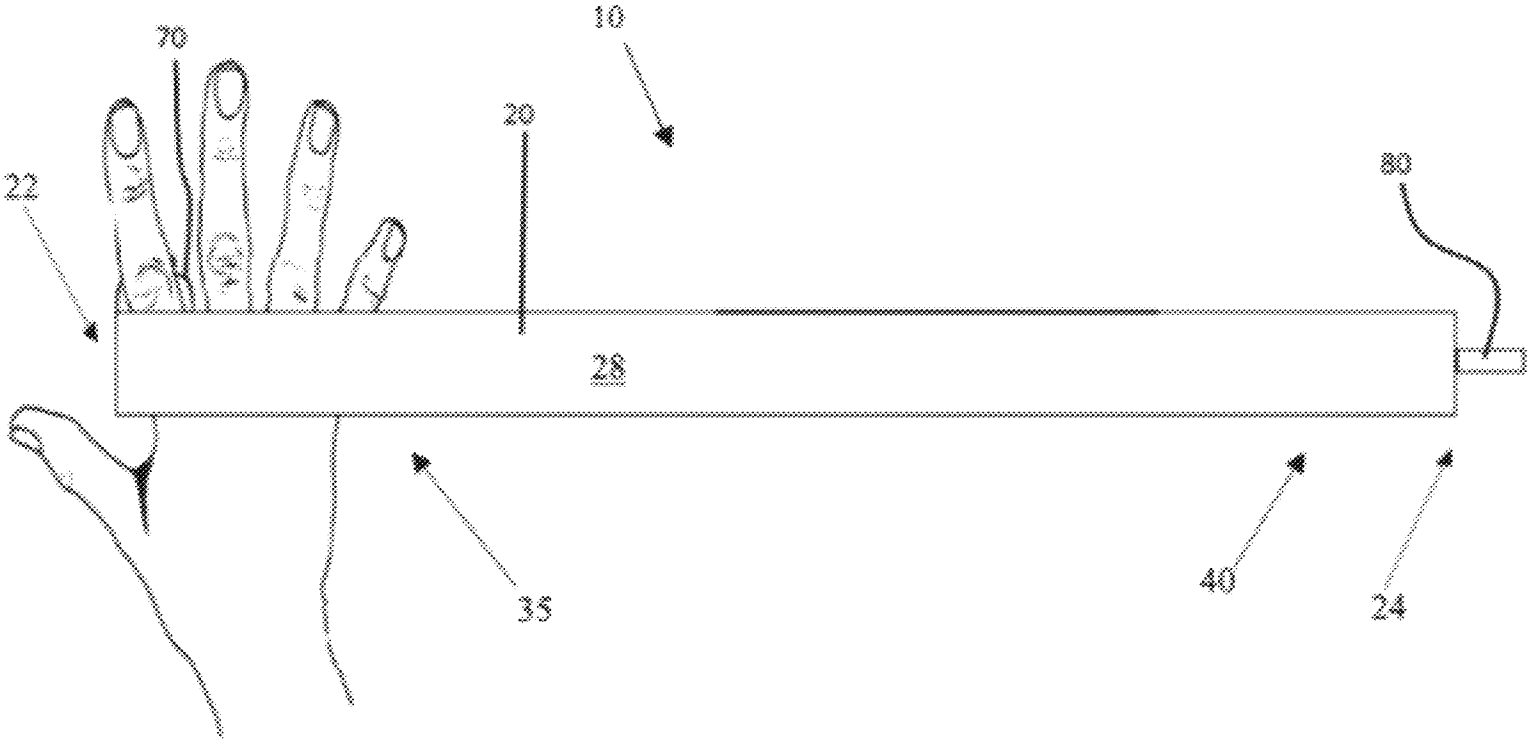
FIG. 2 is a top view of an exemplary embodiment of a hand wrap 10 generally provided in FIG. 1, wherein the hand wrap 10 is positioned to be wrapped around the user's hand.
Figure 3:
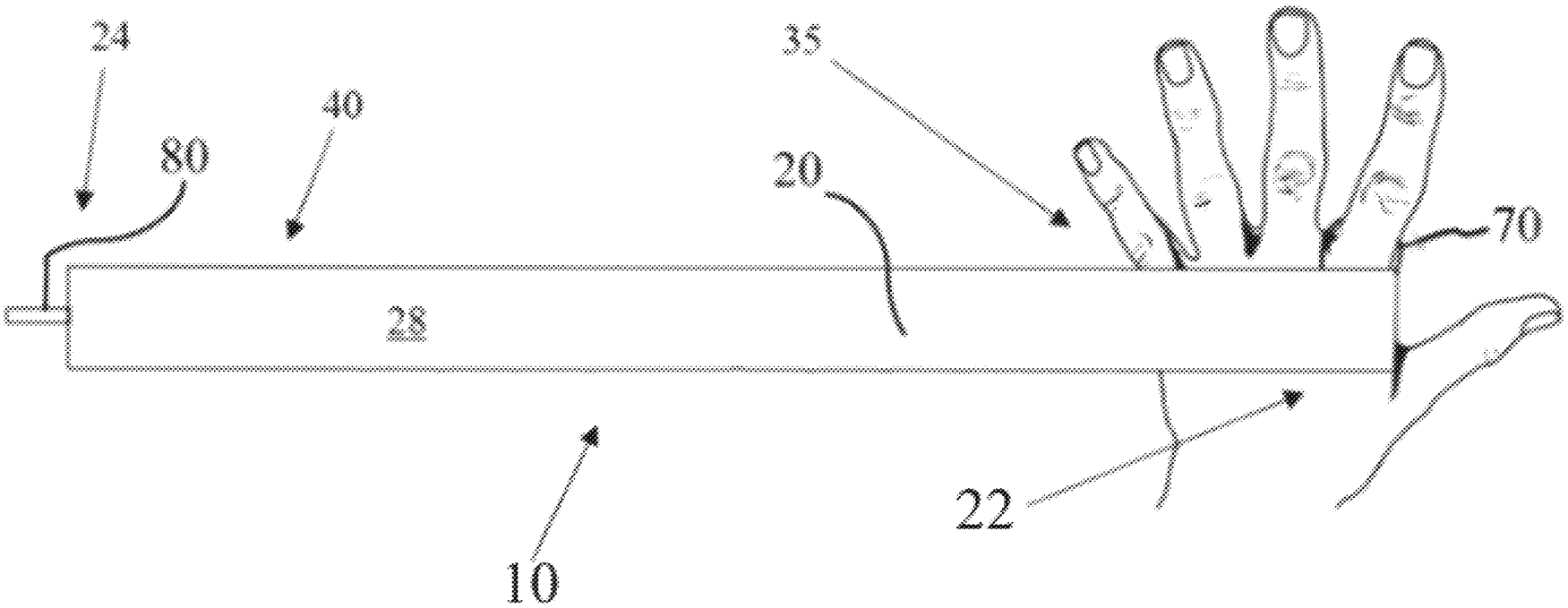
FIG. 3 is a top view of an exemplary embodiment of a hand wrap 10 that is designed for the left hand.

In some embodiments, the hand wrap 10 is specifically designed for either the right hand or the left hand of a user. In other words, the glove specifically designed for use with a right hand would not be compatible for use with the left hand. As shown in FIG. 2, an embodiment of the invention is specifically designed for the right hand of a user. As shown in FIG. 3, an embodiment of the invention is specifically designed for the left hand of a user.

In some embodiments the wrap material 20 is made up one region. In some embodiments the wrap material is made up of multiple regions. In some embodiments wherein the wrap has multiple regions, and as shown in the figures, there is a first region 35 and a second region 40. As shown in the figures, the second region 40 may comprise of a thicker material than the first region 35. In all embodiments with a second region 40, the second region 40 is distinguished as a thicker region and configured or designed to make contact with the palmar side of the user's wrist when worn. In some embodiments, the thickness of the wrap material 20 is increased by adding an additional layer 45. In some embodiments, the additional layer 45 is attached to and becomes part of the second region 40 by various means including, but not limited to, gluing, sewing, or a combination of various methods. In some embodiments, the second region 40 is approximately double the thickness of the first region 35. In some embodiments, the second region 40 is designed to be positioned on or near the palmar sides of the wrists of the user in a supporting manner when worn by the user. This support can provide protection to the user from an injury due to various movements including lateral or extension movements.

Figure 4:
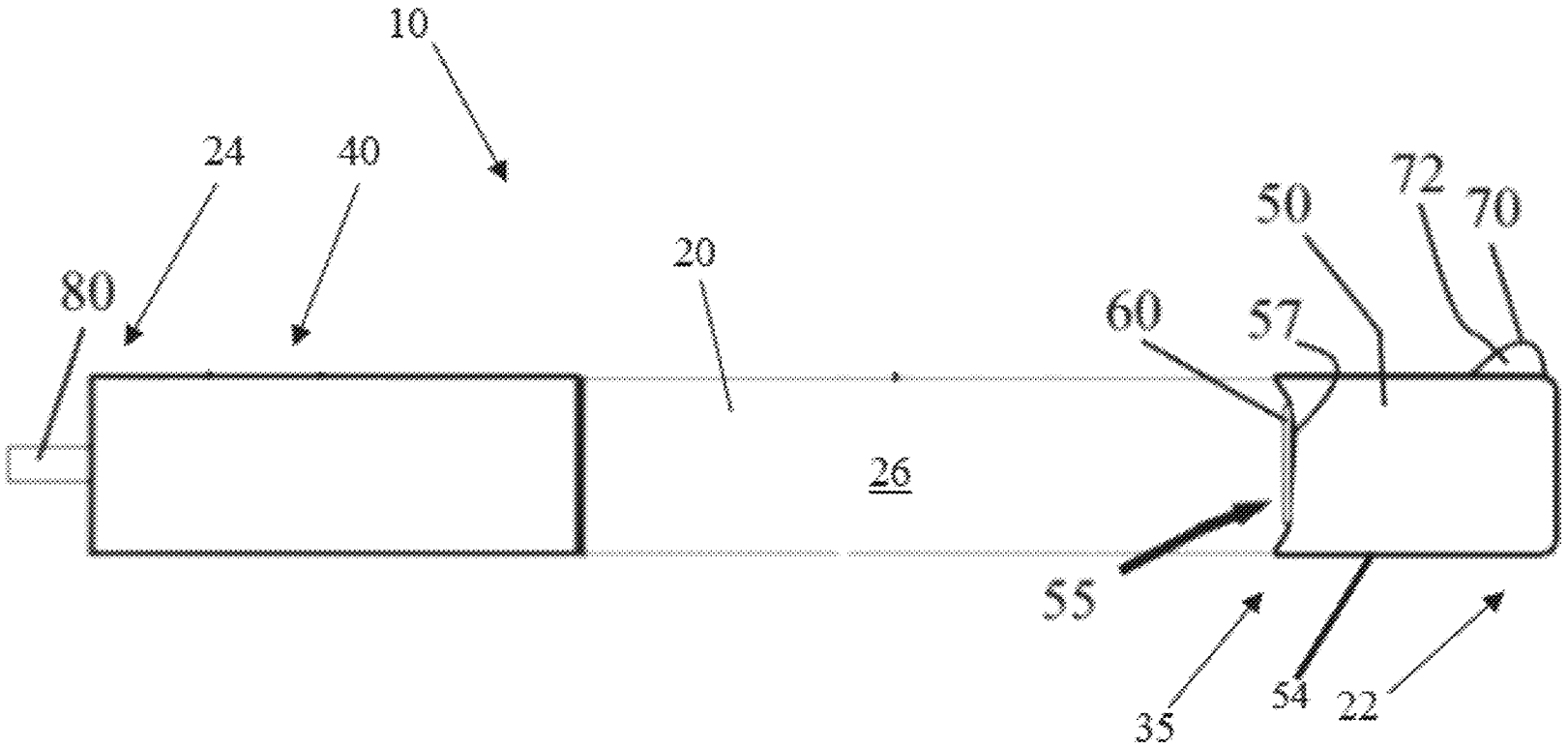
FIG. 4 is a bottom view of an exemplary embodiment of a hand wrap 10.
Figure 5:
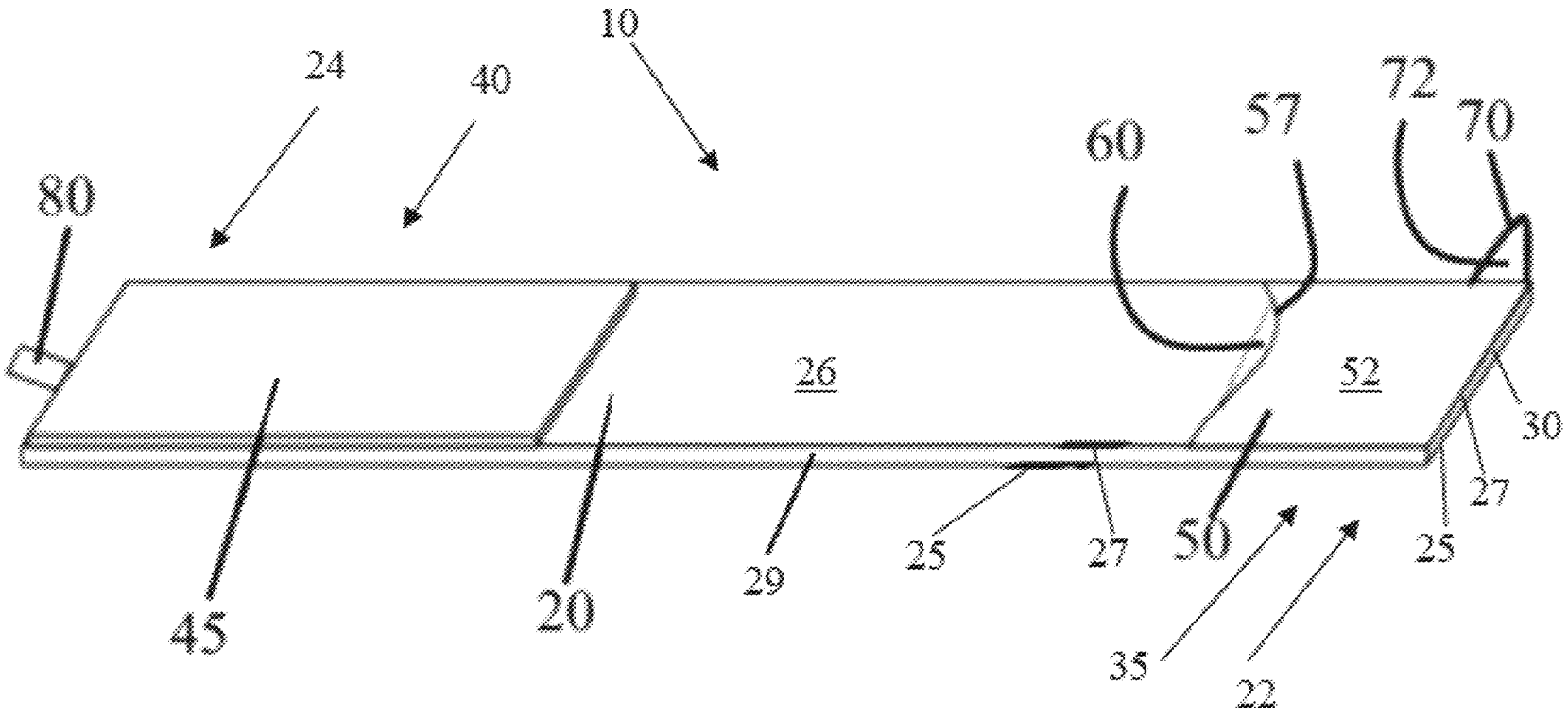
FIG. 5 is a bottom-back elevated view of an exemplary embodiment of a hand wrap 10.
Figure 6:
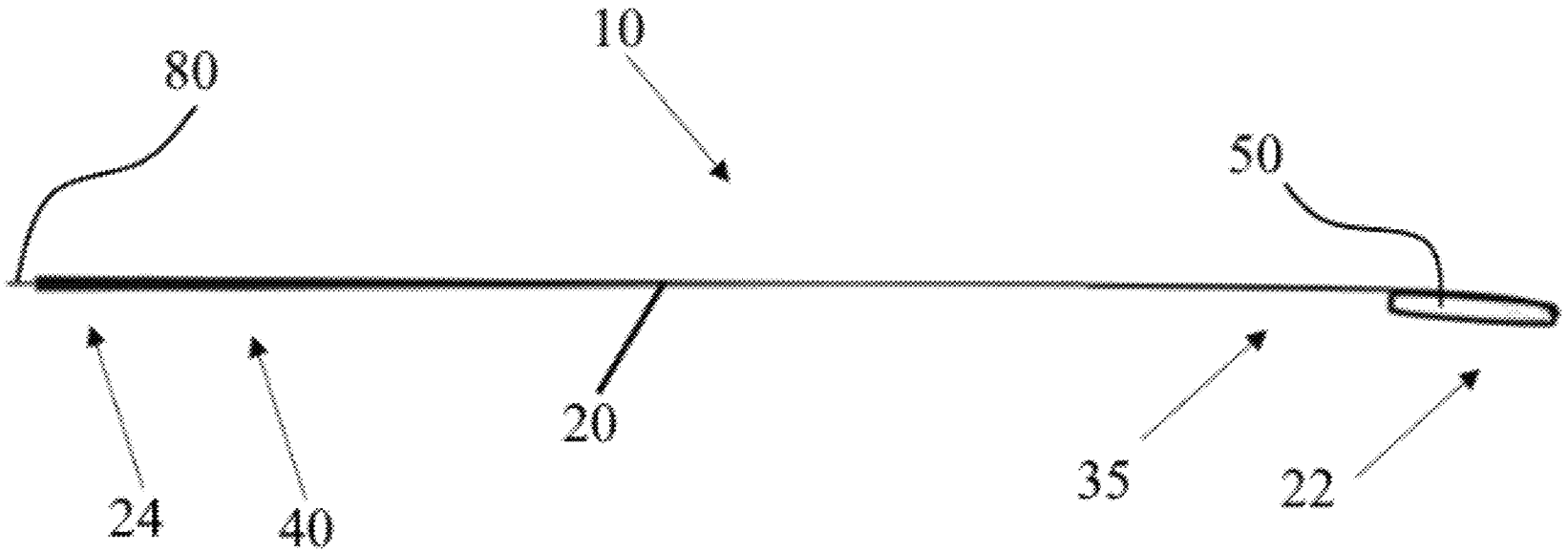
FIG. 6 is a bottom view of an exemplary embodiment of a hand wrap 10.
Figure 7:
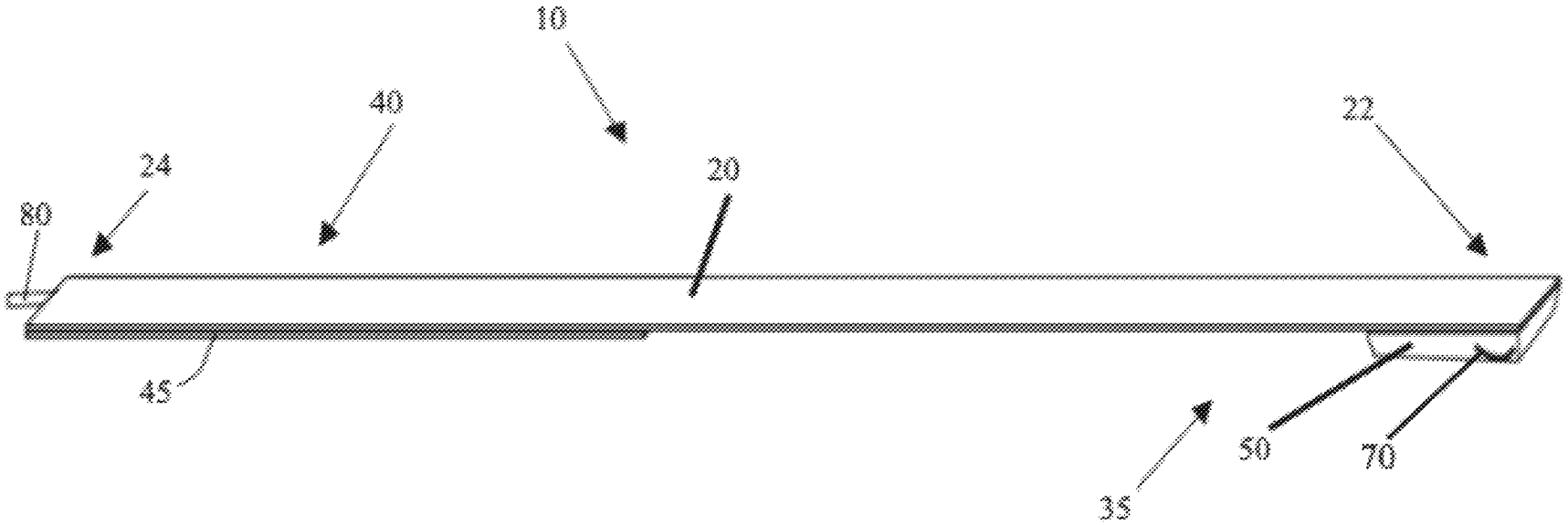
FIG. 7 is a top-front elevated view of an exemplary embodiment of a hand wrap 10.
Figure 8:
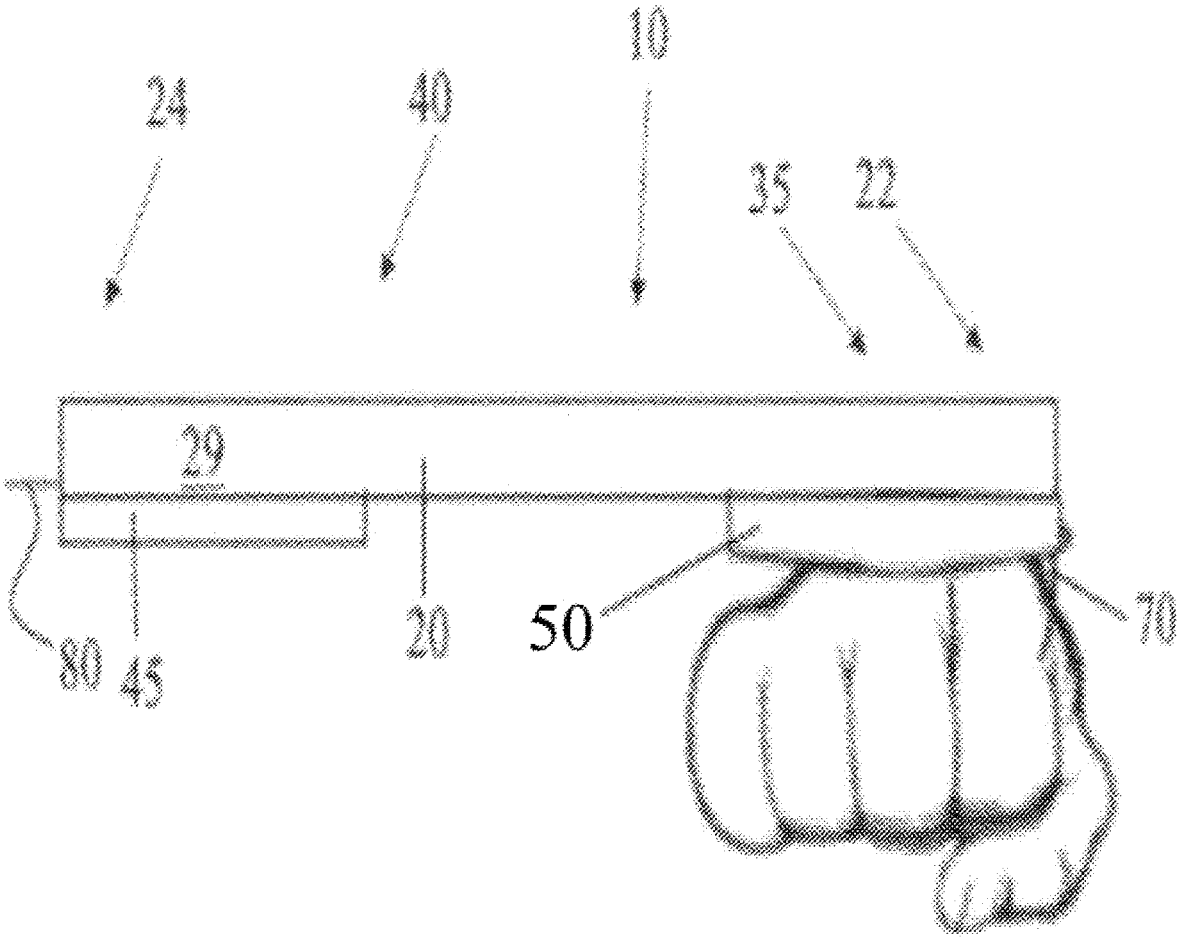
FIG. 8 is a front view of an exemplary embodiment of a hand wrap 10, wherein the hand wrap 10 is position to be wrapped around the user's hand and the loop 70 is positioned around the index finger of the user; and, FIG. 9. is a flow-chart is an example process in forming or making the hand wrap 10.

As shown in the figures throughout and with extra detail in FIG. 4, the hand wrap 10 includes one or more pockets 50 with an opening 55. In some embodiments, the pocket is located in the first region 35. In some embodiments, the pocket 50 is not located in the second region 40. In some embodiments, the pocket 50 is made of the wrap material 20 itself. In some embodiments, wherein the pocket 50 is made of the wrap material 10 itself, the wrap material 20 folds over itself and is sealed or joined in some manner on all but one side 57 thereby creating the opening 55 of the pocket 50. In some embodiments, the pocket 50 is made of a different material than the wrap material 20. The opening 55 and pocket 50 can be oriented in any direction allowing optimization of the direction of insertion of the insert 60. For example, the opening 55 can be place in a perpendicular or parallel manner to any of the sides or edges of the invention. In all embodiments with a pocket 50 and a second region 40, the pocket 50 is not positioned on, at, or within the second region 40.

In some embodiments, the pocket 50 and opening 55 are designed to hold one or more inserts 60. In some embodiments, the insert 60 is padding. In some embodiments, the insert 60 is neoprene padding. In some embodiments, the insert 60 is waterproof neoprene padding. In some embodiments, the pocket 50 and the insert 60 are combined into one element, wherein both creating a padding effect.

In some embodiments with multiple inserts 60, the multiple inserts 60 are inserted into one or more pockets 50 wherein the multiple inserts 60 are chosen due to differing physical characteristics such as, but not limited to, thickness, elasticity, softness, and hardness. In some embodiments, these differing physical characteristics are substantial. Another example would be one insert 60 comprising of a material composition design to receive an impact of high force while the other inserts 60 are design for comfort, waterproof features, and/or other characteristics.

In some embodiments the insert 60 comprises of neoprene padding and/or neoprene padding in combination with various materials. Generally, the insert 60 can be made of one or more various materials such as, but not limited to, gauze, cotton, polyester, cotton batting, leather, synthetic leather, wool, silk, rayon, nylon, taffeta, horse hair, adhesive, felt, othro gel, rubber, vinyl, polyurethan, polyethylene, polyborosiloxine, ethylvinylacetate, polyvinylchloride various types of foam including, but not limited to, open-cell foams, closed-cell foams, urethane foam, polyurethane foam, polyvinyl chloride (PVC) foam, memory foam, and other commonly known types of fabric padding, as well as various combinations of these materials.

In some embodiments, the placement of the insert 60 is configured in a manner to optimize protection of the muscles, ligaments, tendons, joints, bones, and other elements of the musculoskeletal system of the user's hand when worn. In some embodiments and as shown in detail in FIGS. 1-3 and 8, a particular focus of placement of the insert 60 is provided in such a manner to optimize protection of the metacarpals of the user.

In some embodiments, the hand wrap 10 includes a loop 70. In some embodiments, the loop 70 is attached to the wrap material 20 or the pocket 50. In some embodiments, the loop 70 is attached to both the wrap material 20 and the pocket 50. Some example embodiments of the invention, wherein the loop 70 is attached to the pocket 50. In some embodiments, the loop 70 is elastic. In some embodiments, the loop 70 is partially elastic. In some embodiments, the loop 70 is made of one material. In some embodiments the loop 70 is made of two or more materials. In some embodiments, and as shown in detail in FIG. 4, the loop 70 forms one aperture 72. In some embodiments, the loop 70 forms multiple apertures 72, such as two, three, four, five, six, seven, eight, nine, ten, eleven, twelve apertures and so on.

In some embodiments, the aperture 72 of the loop 70 is functionally designed for insertion of a finger before the hand wrap 10 is worn on the user's hand or placed on the user's hand. In some embodiments, the aperture 72 of the loop 70 is functionally designed for insertion of a pointer finger by the user of the hand wrap 10 when worn. In some embodiments, the insertion of the finger of the user into the loop 70, or insertion of the finger of the user into the aperture 72 of the loop 70, is in a securing manner, wherein assistance in providing placement of the insert 60 becomes available to the user.

In some embodiments, the hand wrap 10 further includes a fastening attachment 80. In some embodiments, the fastening attachment 80 is made of one material. In some embodiments, the fastening attachment 80 is made of two or more different materials. In some embodiments, a fastening attachment 80 is attached to the hand material 20. In some embodiments, the fastening attachment 80 is attached to the second region 40. In some embodiments, the fastening attachment 80 is attached to the invention by means of, but not limited to, glue, sewn, or a combination of such means. In embodiments wherein the fastening attachment 80 is attached onto the end of the second region 40, the advantageous feature of control of placement of the second region on or near the palmar area of the wrist becomes available wherein the user can customize the support of their wrists in terms of both comfort, tightness, and firmness. In some embodiments, the fastening attachment 80 is a loop and hook strip. In some embodiments, the fastening attachment 80 is an overlapping hook and loop that attaches to Velcro securing itself.

The wrap material 20 generally has two ends. In some example embodiments, this is defined as a first end 22 and a second end 24. In some embodiments, the pocket 50 and the first region 35 are positioned at or near the same end. In some embodiments, the pocket 50 and the second region 40 are positioned at or near opposite ends. In some embodiments, the pocket 50 and the loop 70 are positioned at or near the same end. In some embodiments, the pocket 50 and fastening attachment 80 are positioned at or near opposite ends.

In some embodiments, the first region 35 and second region 40 are positioned at or near opposite ends. In some embodiments, the first region 35 and the loop 70 are positioned at or near the same end. In some embodiments, the first region 35 and fastening attachment 80 are positioned at or near the opposite ends. In some embodiments, the loop 70 and fastening attachment 80 are positioned at or near opposite ends. In some embodiments the second region 40 is positioned at or near the end of the wrap material 20 that is opposite of the placement of the pocket 50 wherein the additional layer 45 is added to the second region 40 to increase the thickness of the second region 40.

In some embodiments the user's hand makes first contact with the inferior side 26 of the wrap material 20 when first wearing or beginning to wear the hand wrap 10. In some embodiments, and as shown in throughout the figures, the pocket 50 is on the inferior side 26 and the user's hand first makes contact with the pocket 50 when making contact with the inferior side of the wrap material 20. The side opposite of the inferior side 26 is identified as the superior side 28. When identifying a region, such as the first region 35 or the second region 40, both the inferior side 26 and superior side 28 of the wrap material 20 are included in said region.

In some embodiments the pocket 50 is positioned at or near the inferior side 26. The side of the pocket 50 that is exposed is a pocket inferior side 52, wherein the pocket has three pocket edges 54 and the pocket opening 55. In some embodiments the added layer 45 is positioned at or near the inferior side 26. In some embodiments, the loop 70 is positioned at or near the inferior side 26, the superior side 28, an edge of the inferior side 27, an edge of the superior side 25, one of the pocket edges 54, the pocket's inferior side 52, one or more lateral sides 29, one or more end sides 30, or any combination of these. In some embodiments, the fastening attachment 80 is positioned at or near the inferior side 26, the superior side 28, an edge of the inferior side 27, an edge of the superior side 28, one or more of the lateral sides 29, one or more of the end sides 30, or any combination of these. As shown throughout the drawings, the sides of the wrap material 20 that are longitudinally parallel with both the inferior side 26 and superior side 28 are identified as the lateral sides 29 of the wrap material 20. The sides of the wrap material 20 that are longitudinally perpendicular of the inferior side 26, the superior side 28, and the lateral sides 29 are the end sides 30. Each one of the two end sides 30 define a starting edge of either the first end 22 or the second end 24 of the wrap material 20.

The weight of elements of the hand wrap 10 may be customized to the user's preference or based on the anatomical characteristics of the user and/or the user's hand. These elements of the hand wrap that have customizable weight include, but are not limited to, the wrap material 20 the first region 35 of the wrap material 20, the second region 40 of the wrap material 20, the added layer 45 of the second region 40, the pocket 50, the insert 60, the loop 70, and/or the fastening attachment 80. In some embodiments of the invention, elements of the hand wrap 10 will be increased or decreased in weight and/or density. For example, the second region of the hand wrap may be increased in weight. An increase in weight may be for protection. An increase in weight may be to simulate a certain weight of a glove, such as for example, but not limited to, 4 oz, 6 oz, 8 oz, 10 oz, 12 oz, 14 oz, 16 oz, 18 oz and 20 oz gloves. To be clear, oz is the abbreviation of the unit of weight, ounces. Other increments of weight based off of measurements such as, but not limited to, grams and kilograms would be available as customizable choices to the user.

In some embodiments, the wrap material 20, the first region 35 of the wrap material 20, the second region 40 of the wrap material 20, the added layer 45 of the second region 40, the pocket 50, the insert 60, the loop 70, and/or the fastening attachment 80 are flexible. In some embodiments, the wrap material 20, the first region 35 of the wrap material 20, the second region 40 of the wrap material 20, the added layer 45 of the second region 40, the pocket 50, the insert 60, the loop 70, and/or the fastening attachment 80 are semi-rigid. In some embodiments, the surfaces of the wrap material 20, the first region 35 of the wrap material 20, the second region 40 of the wrap material 20, the added layer 45 of the second region 40, the pocket 50, the insert 60, the loop 70, and/or the fastening attachment 80 are continuously flexible. In some embodiments, the surfaces of the wrap material 20, the first region 35 of the wrap material 20, the second region 40 of the wrap material 20, the added layer 45 of the second region 40, the pocket 50, the insert 60, the loop 70, and/or the fastening attachment 80 are continuously smooth.

In some embodiments, and as shown in throughout the figures, the hand wrap 10 is designed to be first positioned over the dorsum or dorsal side of the user's hand, wherein the wrap material 20, the at least one pocket 50 and/or the at least one insert 60 make initial contact with the dorsum or dorsal side of the user's hand. Then the wrap material 20 is wrapped around the medial and then the lateral sides of the user's hand in a repeating manner. The wrap material 20 can also be wrapped around the lateral and then the medial side of the user's hand in a repeating manner. In some embodiments, as the wrap material 20 is first positioned over the dorsum side of the user's hand the at least one insert 60 is positioned to provide protection to the metacarpal bones of user's hand in an optimized manner.

During this process of wrapping the wrap material 20 around the user's hand, the user has the ability to wrap their hands to their preference with the wrap material 20. In some embodiments, upon wearing the invention the user will wrap the hand wrap 10 several times around the user's hand and the second region 40 is positioned to be the last portion of the wrap material 20 to become wrapped around the hand of the user. In some embodiments, during the wrapping process the length of the user's hand is longitudinally parallel with the end sides 30, and longitudinally perpendicular with the inferior side 26, the superior side 28 and the lateral sides 29.

Figure 9:
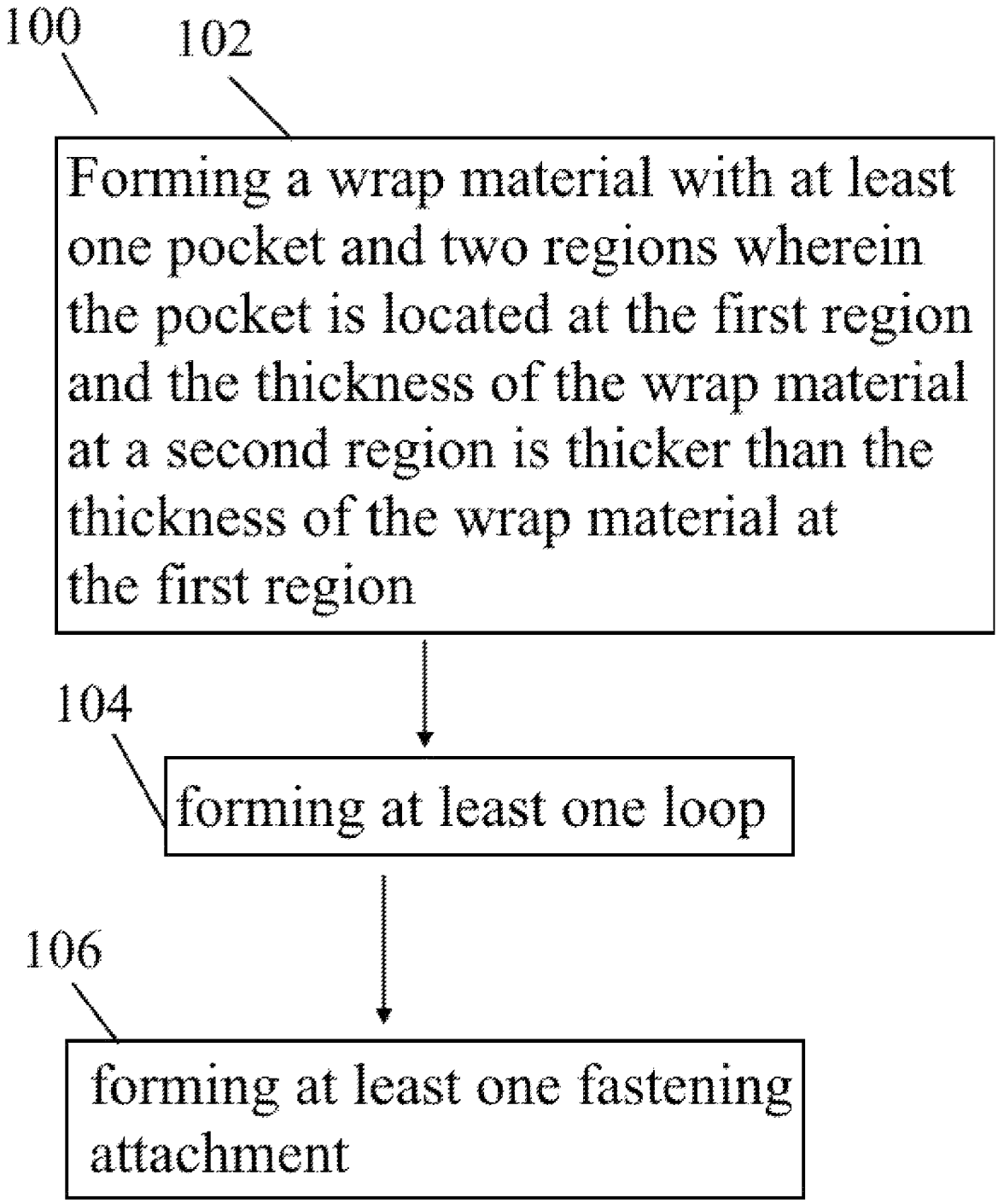

FIG. 9 is a flow chart of an example process 100 for making a hand wrap. In some implementations, the process includes forming a wrap material with at least one pocket and two regions wherein the pocket is located at the first region and the thickness of the wrap material at a second region is thicker than the thickness of wrap material at the first region 102.

In some implementations, the process includes forming a wrap material with at least one pocket and two regions wherein the pocket is located at the first region and the thickness of the wrap material at a second region is thicker than the thickness of wrap material at the first region 102, and the step of forming at least one loop 104; and, forming at least one fastening attachments 106.

In some implementations, the process further includes forming an opening 55 in the pocket 50. In some implementations, the process further includes placing an insert 60 in the opening of the pocket 50.

In some implementations, the process further includes an insert 60 being formed wherein the insert is formed from rubber, leather, neoprene or a combination of these. In some implementations, the process further includes an insert 60 being formed wherein the insert is formed from one or more various materials such as, but not limited to, gauze, cotton, polyester, cotton batting, leather, synthetic leather, wool, silk, rayon, nylon, taffeta, horse hair, adhesive, felt, othro gel, rubber, vinyl, polyurethan, polyethylene, polyborosiloxine, ethylvinylacetate, polyvinylchloride various types of foam including, but not limited to, open-cell foams, closed-cell foams, urethane foam, polyurethane foam, polyvinyl chloride (PVC) foam, memory foam, and other commonly known types of fabric padding, as well as various combinations of these materials.

In some implementations, the process further includes the wrap material 20 is formed from a continuous flexible material. In some implementations, the process further includes any combination of the loop 70 the fastening attachment 80 the wrap material 20 and the pocket 50 are formed from a continuous flexible material.

In some implementations, the process further includes forming the wrap material 20 with two ends wherein the fastening attachment 80 and the at least one loop are formed 70 at opposite ends. In some implementations, the process further includes forming the wrap material 20 with two ends wherein the fastening attachment 80 and second region 40 are at one end and the at least one loop are formed 70 and the first region 35 are at the opposite end. In some implementations, the process further includes forming the wrap material 20 with two ends wherein the second region 40 is formed and then combined with an added layer 45 wherein the added layer 45 is at one end, and the pocket 50 is formed on the opposite end but same side as the added layer 45. The method of forming the invention, such as the position, orientation, and weight of the various components of the invention, can be rearranged in the various manner as discussed in describing the invention itself throughout this specification.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A hand wrap comprising of at least one loop, at least one fastening attachment mechanism, at least one pocket and a wrap material wherein the wrap material further comprises of at least two regions, wherein the pocket is positioned at a first region and the thickness of the wrap material at a second region is thicker than the thickness of wrap material at the first region. wherein the hand wrap further comprises of an insert, wherein the insert is positioned within the pocket. wherein the insert is neoprene padding.

2. The hand wrap of claim 1, wherein the thickness of the second region is about twice the thickness of the first region.

3. The hand wrap of claim 1, wherein the second region is configured to be positioned at the palmar side of a wrist of the user when the hand wrap is worn by the user.

4. The hand wrap of claim 1, wherein all of the regions of the wrap material are made of the same material.

5. The hand wrap of claim 1, wherein the second region is made of two different materials.

6. The hand wrap of claim 1, wherein the loop is attached to the first region.

7. The hand wrap of claim 1, wherein the loop is configured to receive a user's index finger when worn.

8. The hand wrap of claim 1, wherein the hand wrap is designed to be specifically compatible with either a right hand or a left hand of a user.

9. A hand wrap comprising of at least one loop, at least one fastening attachment mechanism, at least one pocket and a wrap material wherein the wrap material further comprises of at least two regions. wherein the pocket is positioned at a first region and the thickness of the wrap material at a second region is thicker than the thickness of wrap material at the first region wherein the hand wrap further comprises of multiple inserts, wherein the multiple inserts are positioned into the pocket and the multiple inserts have substantial differing physical characteristics from each other.

10. A method of forming an exercise grip, comprising:

forming a wrap material with at least one pocket and two regions wherein the pocket is located at the first region and the thickness of the wrap material at a second region is thicker than the thickness of wrap material at the first region, wherein the pocket is formed with an opening and an insert is placed within the pocket by way of the insert wherein the insert is made of orthogel;

forming at least one loop; and, forming at least one fastening attachments.

11. The method of claim 10, wherein the wrap material is formed from a continuous flexible material.

12. The method of claim 10, wherein the wrap material is formed with a first end and a second end opposite to the first end, and wherein the fastening attachment is located at the first end and the at least one loop is located at the second end.

13. The method of claim 10, wherein the wrap material has a first end and a second end opposite to the first end, wherein the fastening attachment and second region are located at the first end and the at least one loop and the pocket are located at the second end.

14. The method of claim 10, wherein the wrap material has has a first end and a second end that is opposite to the first end, wherein the second region is thicker because the second region includes an added layer, wherein the second region is located at the first end, wherein the pocket is located at the second end, and wherein the added layer and the pocket are located on a same side of the wrap material.

* * * * *